United States Patent [19]
Langenfeld et al.
[11] 4,266,906
[45] May 12, 1981

[54] MATERIALS HANDLING DEVICE AND THE METHOD OF MOUNTING THE SAME ON A TRACTOR

[75] Inventors: Joseph W. Langenfeld; Neal W. Westendorf, both of Onawa, Iowa

[73] Assignee: Westendorf Manufacturing Co., Onawa, Iowa

[21] Appl. No.: 52,904

[22] Filed: Jun. 28, 1979

[51] Int. Cl.[3] ..... E02F 3/70
[52] U.S. Cl. ..... 414/686; 414/786; 172/274
[58] Field of Search ..... 414/686, 786; 172/272, 172/273–275

[56] References Cited

U.S. PATENT DOCUMENTS

| | | | |
|---|---|---|---|
| 3,554,396 | 1/1971 | Demkin | 172/275 X |
| 3,863,786 | 2/1975 | Frank | 414/686 |
| 3,991,890 | 11/1976 | Frank | 414/686 |
| 4,051,962 | 10/1977 | Westendorf | 414/686 |

FOREIGN PATENT DOCUMENTS

| | | | |
|---|---|---|---|
| 2902990 | 8/1979 | Fed. Rep. of Germany | 414/686 |

*Primary Examiner*—Charles A. Marmor

[57] ABSTRACT

A materials handling device or tractor loader is described as well as the method of mounting the same on a tractor. The loader device comprises a U-shaped sub-frame comprising a transversely extending forward end which is received by a pocket or channel mounted on the forward end of the tractor. The sub-frame also comprises side frame members which extend upwardly and rearwardly from the transversely extending forward end. The rearward ends of the side frame members are secured to upright towers adjacent the upper end thereof. A boom assembly is secured to the upper ends of the towers and extends forwardly therefrom and has a materials handling implement mounted on the forward end thereof. A hydraulic cylinder extends between the towers and the boom assembly for pivotally moving the boom assembly relative to the sub-frame and the towers. Each of the towers is provided with a rearwardly presented U-shaped channel at the lower end thereof which is adapted to receive a mounting support which extends laterally from the tractor. A finger or hook is secured to each of the towers at the upper rearward end of the associated channel and extends rearwardly and downwardly therefrom for pivotal engagement with the laterally extending support during the mounting and dismounting of the loader device.

4 Claims, 11 Drawing Figures

MATERIALS HANDLING DEVICE AND THE METHOD OF MOUNTING THE SAME ON A TRACTOR

BACKGROUND OF THE INVENTION

A large number of tractor loaders have been previously described wherein means has been provided for quickly mounting the loader on the tractor. One such loader is illustrated in U.S. Pat. No. 3,324,954 which issued to Walter J. Westendorf on June 13, 1967 and which has met with a great amount of success. In the loader of U.S. Pat. No. 3,324,954, the side frame members of the loader sub-frame engage a pair of supports which extend laterally from opposite sides of the tractor adjacent the forward end thereof in the vicinity of the front wheels. The loader sub-frame is pivotally moved on the laterally extending supports until the sub-frame is properly positioned for attachment to the tractor.

Extremely large four-wheel drive tractors have recently become very popular. In the four-wheel drive tractors such as the Oliver Model 2150, the required front wheel and front axle clearance makes it impossible to provide laterally extending supports of the Westendorf type at the forward end of the tractor over which to pivot the loader during the mounting and dismounting of the same. In other words, the front wheels of the tractor would strike laterally extending supports when the tractor was turned. Further, the vertical movement of the front axle, as well as the turning movement of the wheels, makes it impossible to position horizontally disposed side frame members between the front wheels and the tractor.

Therefore, it is a principal object of the invention to provide an improved loader device and the method of mounting the same.

A still further object of the invention is to provide a tractor loader which may be mounted on the large four-wheel drive tractors.

A still further object of the invention is to provide a tractor loader which is pivoted with respect to laterally extending supports positioned rearwardly of the front wheels of the tractor.

A still further object of the invention is to provide a tractor loader including means at the lower end of tower supports which prevents the loader from objectionably moving during the mounting of the loader and which aids in aligning the connection means at the lower ends of the towers.

A still further object of the invention is to provide a tractor loader which is quickly and easily mountable on a tractor and which is quickly and easily dismounted therefrom.

A still further object of the invention is to provide a tractor loader which is economical of manufacture, durable in use and refined in appearance.

SUMMARY OF THE INVENTION

Figure 1:
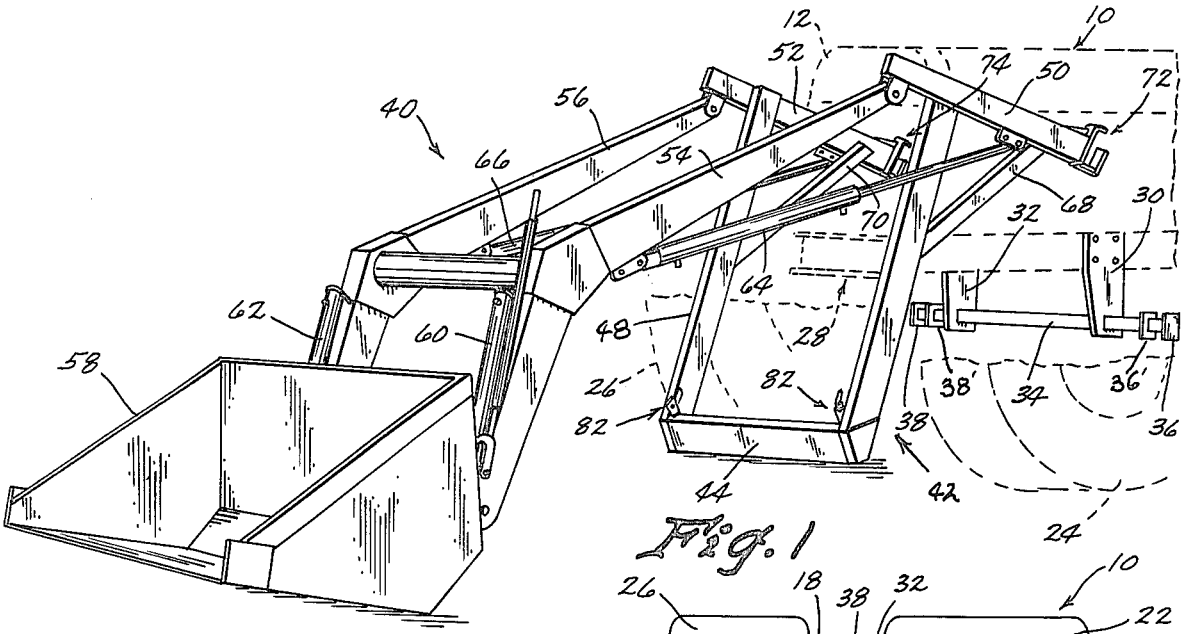
FIG. 1 is a perspective view of the loader device of this invention and a partial perspective view of the tractor.
Figure 2:
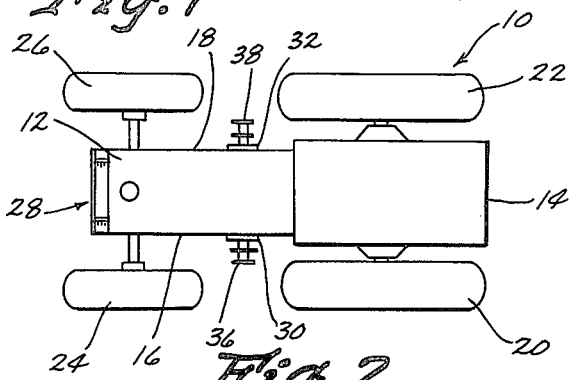
FIG. 2 is a partial top view of the tractor.

The loader device comprises a U-shaped sub-frame comprising a transversely extending forward portion with spaced-apart side frame members extending rearwardly and upwardly therefrom. A tower or upright is secured to the rearward end of each of the side frame members and has a boom arm pivotally secured to the upper end thereof. Hydraulic rams extend between the towers and the boom arms for pivotally moving the boom arms relative to the towers. Each of the towers is provided with a rearwardly presented U-shaped channel which is adapted to receive a support member extending laterally from the tractor. A hook extends rearwardly and downwardly from the upper end of each of the channels for pivotal engagement with the laterally extending support members as the loader is pivotally mounted on the tractor. The hooks not only prevent the loader device from shifting during the mounting of the loader device but also serve to align the channels with the support members. The pivotal engagement of the hooks with the support members enables the sub-frame to pivot over the front axle of the tractor. The method of mounting the loader on the tractor is also described.

DESCRIPTION OF THE PREFERRED EMBODIMENT

The numeral 10 refers generally to a conventional tractor such as the Oliver Model 2150. Tractor 10 includes a forward end 12, rearward end 14 and opposite sides 16 and 18. The tractor also includes rear wheels 20 and 22 and forward wheels 24 and 26.

Figure 3:
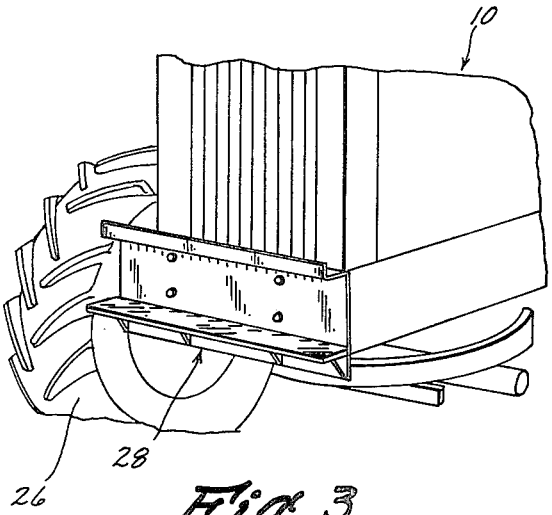
FIG. 3 is a partial front perspective view of the tractor with the channel mounted thereon.
Figure 4:
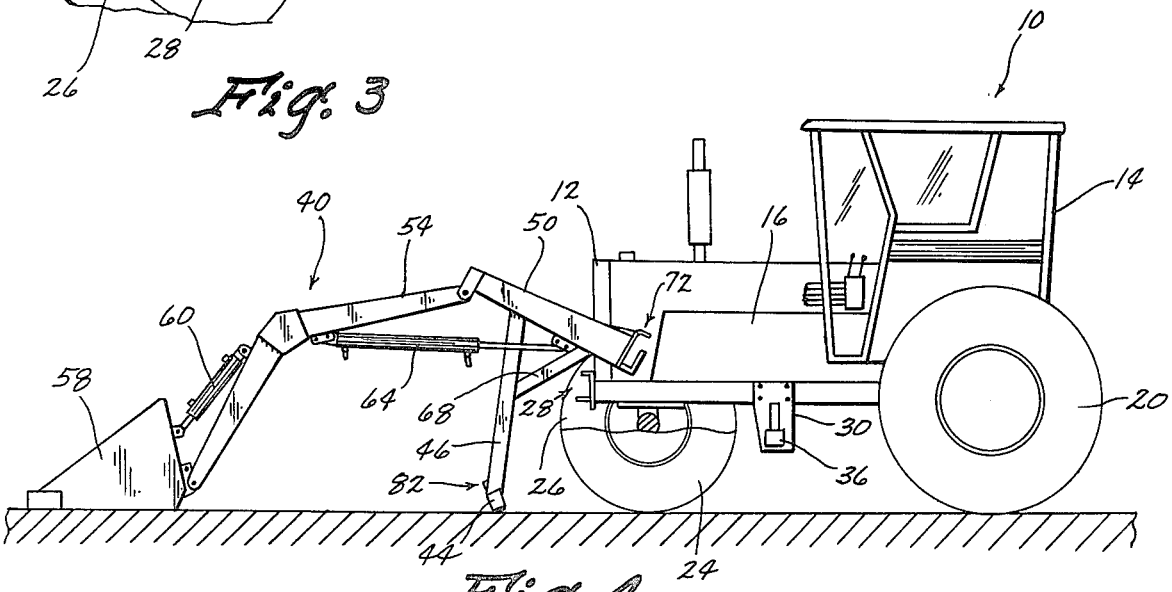
FIG. 4 is a side view of the loader and tractor with the loader being positioned on the ground.

A U-shaped pocket or channel 28 is secured to the forward end of the tractor as best seen in FIG. 3. Support plates 30 and 32 are secured to sides 16 and 18 of tractor 10 by bolts or the like and have a tubular member 34 secured thereto by bolts or the like. Tubular member 34 has its opposite ends positioned outwardly of the sides of the tractor. The outer ends of the tubular member 34 are provided with plate portions 36 and 38 spaced outwardly from plate portions 36' and 38' respectively (FIG. 1).

The numeral 40 refers generally to the loader of this invention. Loader 40 generally comprises a U-shaped sub-frame 42 comprising a transversely extending forward portion 44 and spaced-apart side frame members 46 and 48 extending rearwardly from forward portion 44. Towers 50 and 52 are welded to the rearward ends of side frame members 46 and 48 respectively adjacent the upper ends of the towers. Booms 54 and 56 are pivotally secured to the upper ends of towers 50 and 52 respectively and extend forwardly therefrom. The numeral 58 refers to a materials handling implement such as a bucket which is pivotally secured to the forward ends of the booms 54 and 56. Hydraulic cylinders 60 and 62 are pivotally secured to and extend between the implement 58 and the booms 54 and 56 to cause the pivotal movement of the implement 58 relative to the booms.

Hydraulic cylinders 64 and 66 are pivotally connected at their base ends to the booms 54 and 56 as illustrated and have their rod ends pivotally secured to the towers intermediate the lengths thereof as illustrated in the drawings. Braces 68 and 70 are secured at the rearward ends to the towers 50 and 52 respectively and are secured at their forward ends to the side frame members 46 and 48 respectively intermediate the lengths thereof. Thus, when the loader is mounted on the tractor, side frame members 46 and 48 extend upwardly and rearwardly from the forward portion of the tractor while the braces 68 and 70 extend upwardly and forwardly towards the side frame members from the towers. Thus, side frame members 46, 48 and braces 68, 70 define an inverted V-shaped to provide sufficient clearance for the axle at the forward end of the tractor.

The towers 50 and 52 are provided with rearwardly presented U-shaped channels 72 and 74 respectively at the lower end thereof. The numeral 76 refers to a finger or hook which extends downwardly from the upper rearward end of the channels 72 and 74 adapted for engagement with the laterally extending portions of the tube 34 as will be described in more detail hereinafter. The numeral 82 refers generally to a locking apparatus provided on the forward portion 44 of the sub-frame 42 which is adapted to automatically lock onto the channel 28 when forward portion 44 is received in the channel 28. The locking assembly does not form a part of this invention but is described in U.S. Pat. No. 4,051,962.

Figure 5:
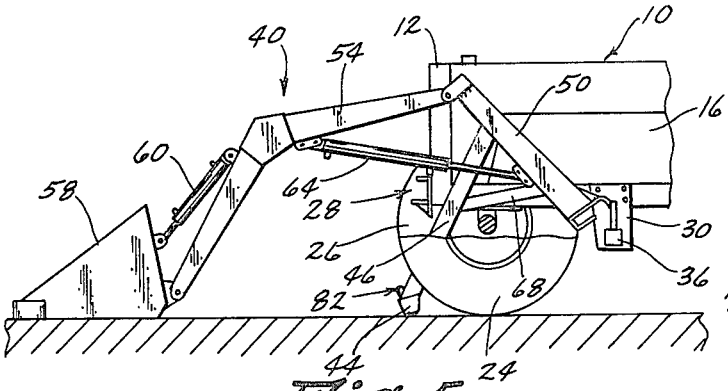
FIGS. 5, 7 and 9 are views similar to FIG. 4 illustrating the sequential steps of mounting the loader on the tractor.
Figure 6:
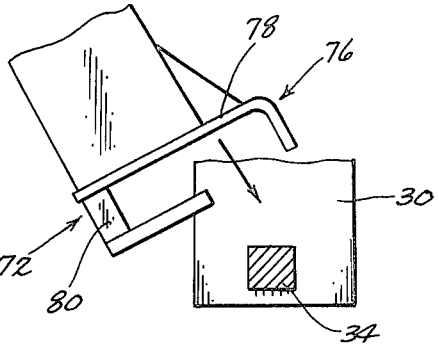
FIGS. 6, 8 and 10 are enlarged sectional views illustrating the sequential relationship of the means for securing the towers to the tractor.
Figure 7:
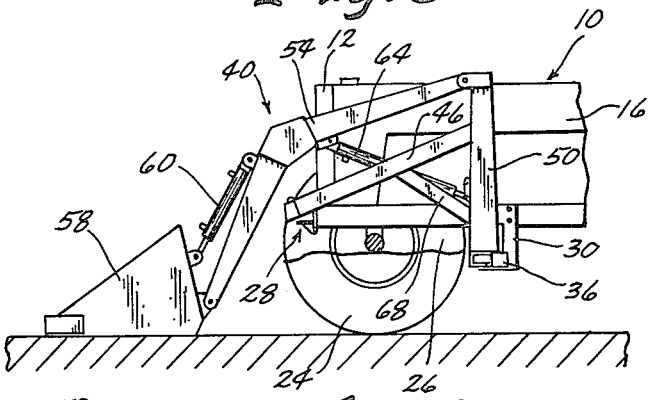
Figure 8:
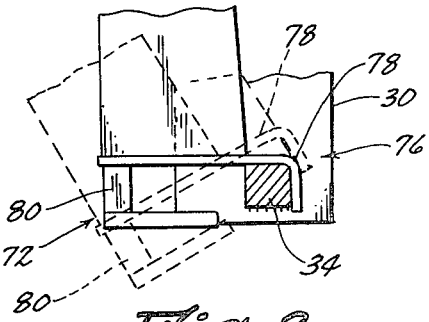
Figure 9:
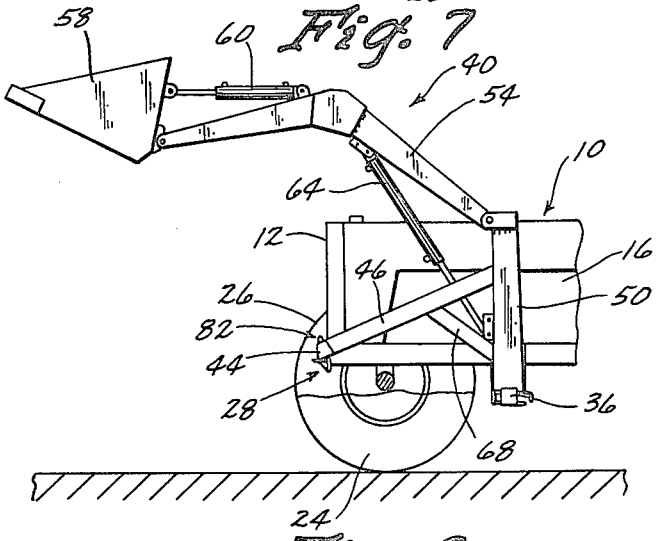
Figure 10:
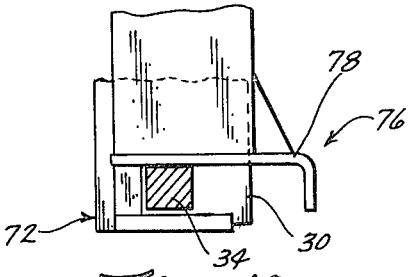
Figure 11:
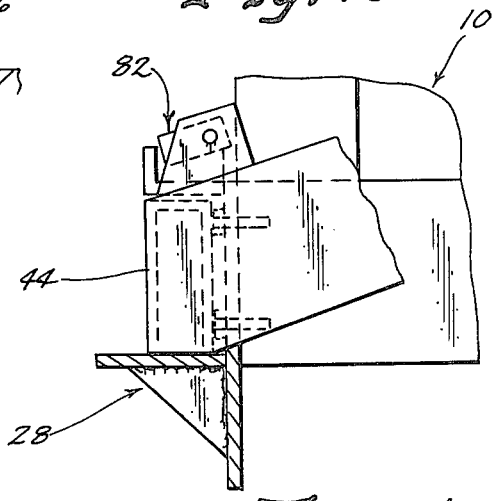
FIG. 11 is a partial sectional view illustrating the sub-frame being received in the pocket at the forward end of the tractor.

The loader is mounted on the tractor as follows. Initially, the loader will be positioned on the ground as illustrated in FIG. 1 so that the forward portion 44 of sub-frame 42 is in ground engagement with the side frame members 46 and 48 extending upwardly and rearwardly therefrom. However, it should be noted that forward portion 44 could be supported above the ground by a suitable stand means or the like if desired, although the preferred arrangement is that which is shown in the drawings. The tractor 10 is driven adjacent the rearward end of the loader so that the forward portion of the tractor is received between the towers 50 and 52. The hydraulic cylinders 64 and 66 are then connected to the hydraulic system on the tractor in conventional fashion. The hydraulic cylinders 64 and 66 are then operated to retract the same which causes the sub-frame 42 to pivot relative to the booms or in a clockwise manner as illustrated in FIG. 5. Retraction of the cylinder rods into the hydraulic cylinders 64 and 66 causes the lower ends of the towers 50 and 52 to lower towards the laterally extending portions of the tubular member 34. If the tractor 10 is not in the correct position at this time, the tractor is maneuvered so that continued operation of the hydraulic cylinders 64 and 66 will cause the hooks 76 to engage the laterally extending portions of the tubular member 34 between the plate portions provided thereon. The hooks 76 engage the laterally extending portions of the tubular member 34 and continued operation of the hydraulic cylinders 64 and 66 causes the forward portion 44 of sub-frame 42 to be pivotally moved upwardly from its ground engaging portion. In other words, the sub-frame 42 pivots about the laterally extending portions of tube 34 through the engagement of the hooks 76 therewith. The hooks 76 not only prevent the loader from moving longitudinally with respect to the tractor during the mounting operation but serve to provide the pivotal connection between the towers and the tractor during the mounting of the loader on the tractor. The hooks 76 also serve to align the channels 72 and 74 with the tubular member 34. The hydraulic cylinders 64 and 66 are further retracted until the forward portion 44 of sub-frame 42 is in alignment with the channel 28 on the forward portion of the tractor. At this time, the channels 72 and 74 will be substantially horizontally disposed. The tractor is then driven forwardly relative to the loader which causes the laterally extending portions of tube 34 to disengage from the hooks 76 and to be received by the channels 72 and 74 with the forward portion 44 of sub-frame 42 being simultaneously received by the channel 28 at which time the locking mechanism 82 locks the sub-frame onto the tractor.

The fact that the loader pivotally moves relative to the tractor through the pivotal engagement of the hooks 76 with the laterally extending portions of the tube 34 permits the sub-frame to pivot over the front axle of the tractor. The inverted V-shape defined by the braces 68, 70 and the side frame members provides the necessary clearance for the front axle of the tractor. The loader described herein permits the elimination of the laterally extending support members normally found adjacent the forward portion of the tractors near the front wheels.

It should be noted that the locking means described herein which locks the forward portion of the sub-frame to the tractor need not be utilized if some other means is provided for locking the sub-frame to the tractor such as a locking means at the lower end of the towers. The primary purpose of the channel 28 at the forward portion of the tractor is to absorb shocks or stress forces which are transmitted through the loader. The channel 28 also serves to limit upward and downward movement of the forward portion of the sub-frame relative to the tractor.

Thus it can be seen that the loader accomplishes at least all of its stated objectives.

We claim:

1. In combination, a tractor having rearward and forward ends and opposite sides, first and second support members extending laterally from opposite sides of said tractor rearwardly of the forward end thereof, connection means at the forward end of said tractor, and a materials handling apparatus mounted on said first and second support members and said connection means, said apparatus comprising a substantially U-shaped sub-frame means having spaced-apart and rearwardly extending side frame members with rearward and forward ends, a tower member operatively secured to the rearward end of each of said side frame members, a boom member pivotally secured at its rearward end to each of said tower members and extending forwardly therefrom, a materials handling implement at the forward end of said boom members, a hydraulic cylinder means for pivotally moving said boom members relative to said towers, each of said towers having a rearwardly presented U-shaped channel provided at the lower end thereof adapted to receive said laterally extending support members therein, each of said towers having a downwardly extending finger portion at the upper rearward end of said channel which is adapted to pivotally engage one of said first and second laterally extending support members to limit the relative longitudinal movement of the sub-frame means with respect to said tractor and to position said channels relative to said laterally extending support members during power mounting of said apparatus on said tractor.

2. The combination of claim 1 wherein the engagement of said finger portions with said support members also permits said side frame members to be pivotally moved upwardly with respect to the tractor, during said power mounting, without engaging said tractor.

3. The combination of claim 1 wherein each of said side frame members have forward and rearward side frame portions, said forward side frame portions extending upwardly and rearwardly from the forward end of said sub-frame means, said rearward side frame portions being angularly disposed relative to said forward side frame portions and extending upwardly and rearwardly from the rearward ends of said forward side frame portions.

4. The method of mounting a materials handling device on a tractor, said tractor having a support member at each side thereof which extends laterally therefrom substantially rearwardly of the front wheels of the tractor, said materials handling device being initially detached from the tractor and including a first frame means comprising a transversely extending forward portion and spaced-apart side frame members, said first frame means being initially positioned so that the rearward ends of said side frame members are positioned above and rearwardly of said transversely extending forward portion, an upright tower secured to the rearward end of each of said side frame members and having rearward and forward ends, each of said towers having a rearwardly presented channel at its lower end and a downwardly extending finger at the upper rearward end of said channel, a boom pivotally secured at one end to each of said towers and extending forwardly therefrom, a hydraulic ram means pivotally secured to said towers and said booms and extending therebetween, comprising the steps of:

driving the tractor adjacent the materials handling device so that the forward end of the tractor is positioned between said side frame members, operating the hydraulic ram means and positioning said tractor so that said first frame means pivots with respect to said booms to lower said towers relative to said tractor and so that said fingers engage said support members, further operating the hydraulic ram means so that said fingers pivotally engage said support members and so that said fingers pivotally move with respect to said support members until said channels are aligned with said support members to permit said support members to be received by said channels, driving the tractor forwardly with respect to said materials handling device so that said support members are received by said channels, and further connecting said first frame means to said tractor to maintain said materials handling device on said tractor.

* * * * *